US008209871B1

(12) United States Patent
Palmby

(10) Patent No.: US 8,209,871 B1
(45) Date of Patent: Jul. 3, 2012

(54) CUTTING APPARATUS

(76) Inventor: Chris D. Palmby, Bellingham, WA (US)

( * ) Notice: Subject to any disclaimer, the term of this patent is extended or adjusted under 35 U.S.C. 154(b) by 606 days.

(21) Appl. No.: 12/365,956

(22) Filed: Feb. 5, 2009

(51) Int. Cl.
*B26B 13/00* (2006.01)
*B26B 13/16* (2006.01)

(52) U.S. Cl. ..... 30/249; 30/253; 30/261

(58) Field of Classification Search ..... 30/245, 30/254, 258, 261, 262, 244, 246–253, 257, 30/259; 83/607
See application file for complete search history.

(56) References Cited

U.S. PATENT DOCUMENTS

| | | | | | |
|---|---|---|---|---|---|
| 52,337 | A | * | 1/1866 | Surerus | 30/249 |
| 875,240 | A | * | 12/1907 | Brown | 30/251 |
| 906,950 | A | | 12/1908 | Smith | |
| 1,104,495 | A | | 7/1914 | Hansen | |
| 1,197,965 | A | * | 9/1916 | Swanson | 30/252 |
| 1,378,791 | A | * | 5/1921 | Johanson | 30/251 |
| 1,642,532 | A | | 9/1927 | Beauregard | |
| 2,548,243 | A | | 4/1951 | Smith | |
| 2,703,929 | A | | 3/1955 | Boegehold | |
| 2,932,892 | A | * | 4/1960 | Offner | 30/249 |
| 3,372,480 | A | | 3/1968 | Rozmus | |
| 4,958,435 | A | * | 9/1990 | Grubbs et al. | 30/248 |
| 5,092,049 | A | * | 3/1992 | Grubbs et al. | 30/248 |
| 5,193,277 | A | | 3/1993 | Zmijewski | |
| 5,282,315 | A | * | 2/1994 | Martin | 30/251 |
| 6,446,343 | B1 | * | 9/2002 | Huang | 30/249 |
| 2007/0119057 | A1 | * | 5/2007 | Chen | 30/249 |

FOREIGN PATENT DOCUMENTS

| | | | | |
|---|---|---|---|---|
| DE | 34 24 356 | * | 1/1986 | 30/262 |

* cited by examiner

*Primary Examiner* — Clark F. Dexter

(57) ABSTRACT

A cutting apparatus includes a housing that has a first end wall, a second end wall, a first side wall, a second side wall, a front wall and a rear wall. The first end wall has a blade aperture extending therethrough. A fixed blade is mounted in the housing and extends through the blade aperture. The fixed blade includes a sharp edge facing the second side wall. A pivoting blade is pivotally mounted in the housing and extends through the blade aperture. The pivoting blade includes a sharp edge facing the first side wall. The pivoting blade is movable from an open position to a closed position relative to the fixed blade. An actuator is mechanically coupled to the pivoting blade and pulls the pivoting blade toward the fixed blade when actuated.

8 Claims, 3 Drawing Sheets

CUTTING APPARATUS

BACKGROUND OF THE DISCLOSURE

Field of the Disclosure

The disclosure relates to cutting devices and more particularly pertains to a new cutting device for cutting paper articles, small branches, plant material and the like.

SUMMARY OF THE DISCLOSURE

An embodiment of the disclosure meets the needs presented above by generally comprising a housing that has a first end wall, a second end wall and a perimeter wail that is attached to and extends between the first and second end walls. The perimeter wall includes a first side wail, a second side wail, a front wall and a rear wall. The first end wall has a blade aperture extending therethrough. A fixed blade is mounted in the housing and extends through the blade aperture. The fixed blade includes a sharp edge facing the second side wall. A pivoting blade is pivotally mounted in the housing and extends through the blade aperture. The pivoting blade lies in a plane that is parallel to a plane of the fixed blade. The pivoting blade includes a sharp edge facing the first side wall and the fixed blade. The pivoting blade is movable from an open position forming an open space between the fixed and pivoting blades adjacent to the first end to a closed position having no open space between the fixed and pivoting blades adjacent to the first end. An actuator is mechanically coupled to the pivoting blade and pulls the pivoting blade toward the fixed blade when actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
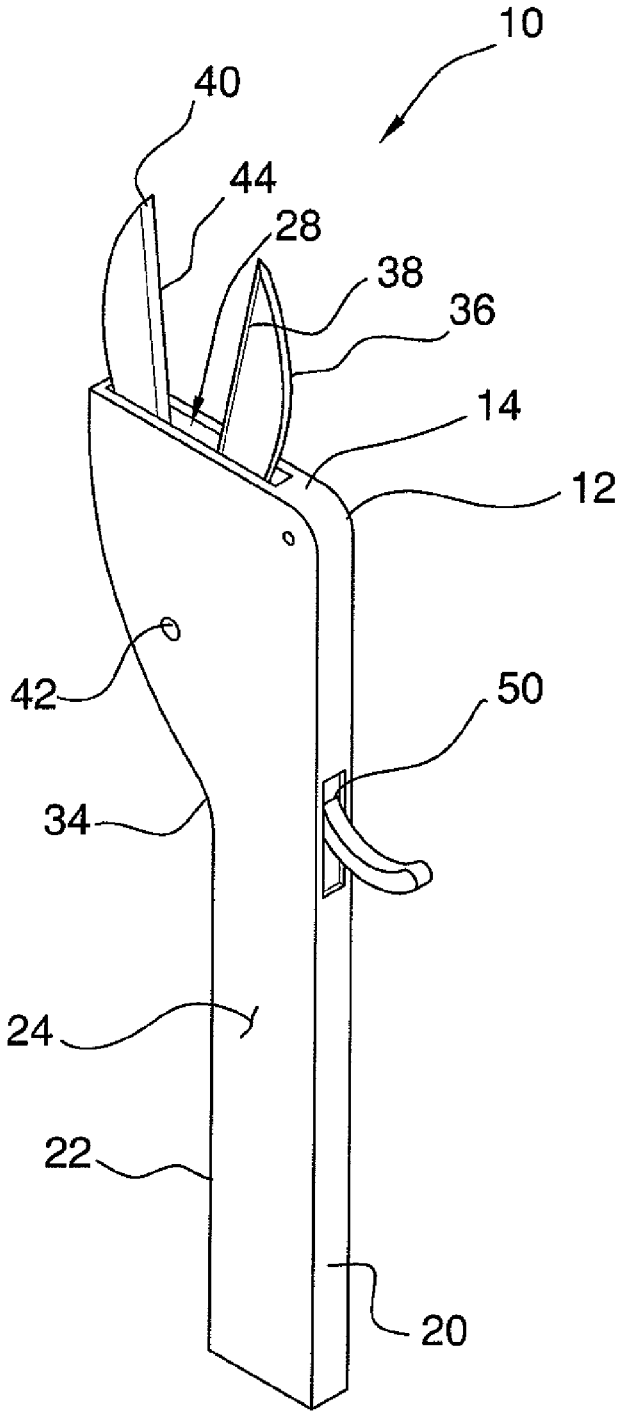
FIG. 1 is a front perspective view of a cutting apparatus according to an embodiment of the disclosure.
Figure 2:
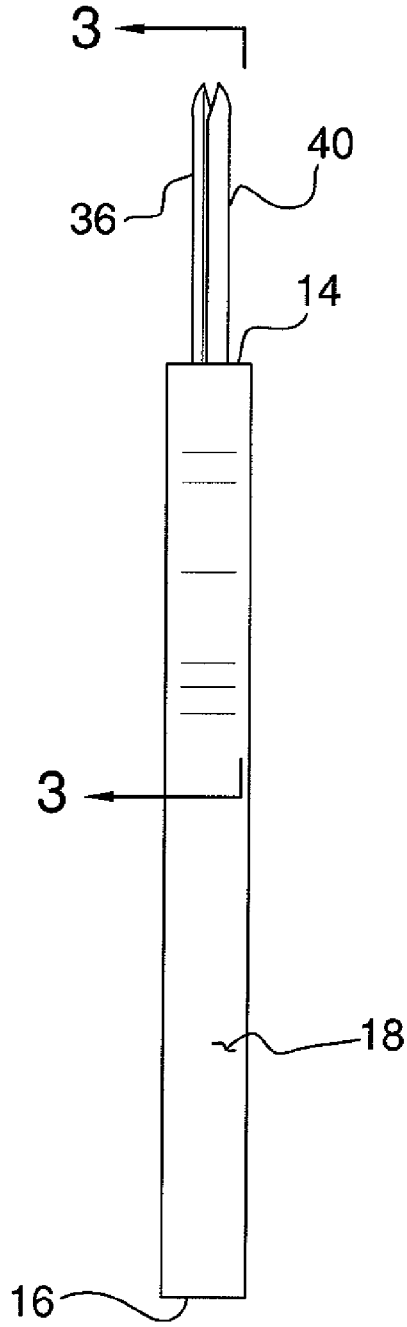
FIG. 2 is a side view of an embodiment of the disclosure.
Figure 3:
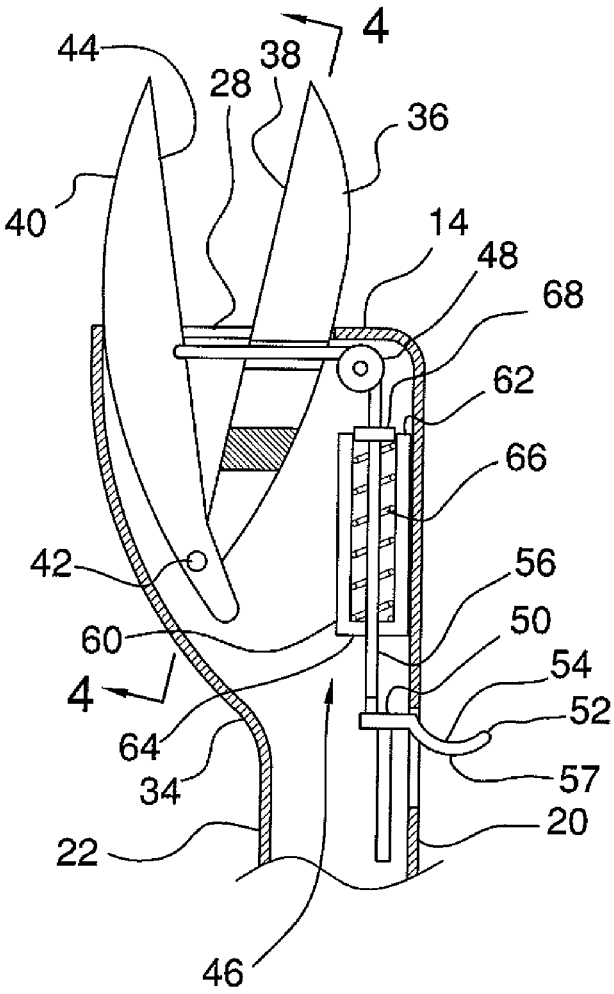
FIG. 3 is a cross-sectional view taken along line 3-3 of FIG. 2 of an embodiment of the disclosure.
Figure 4:
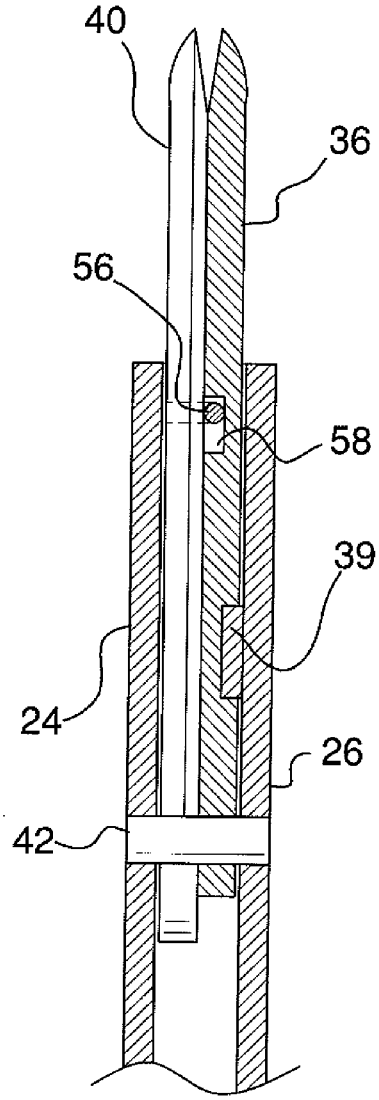
FIG. 4 is a cross-sectional view taken along line 4-4 of FIG. 3 of an embodiment of the disclosure.
Figure 5:
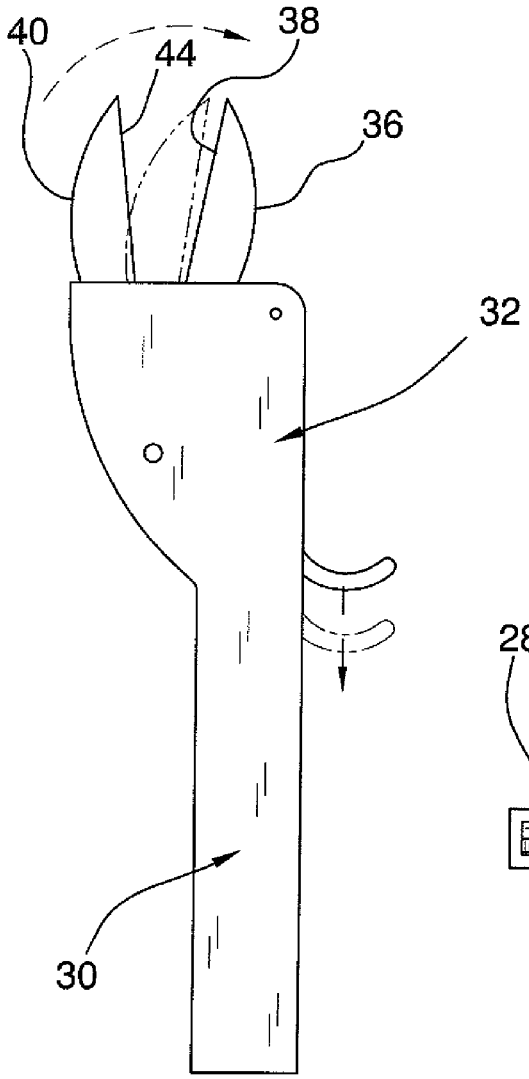
FIG. 5 is a front view of an embodiment of the disclosure.
Figure 6:
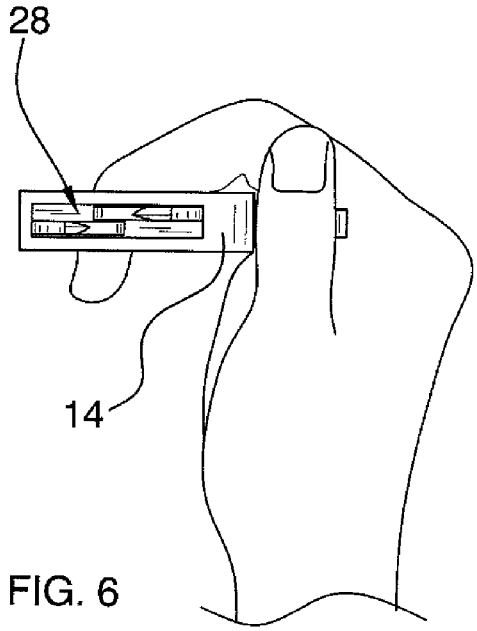
FIG. 6 is a top in-use view of an embodiment of the disclosure.

With reference now to the drawings, and in particular to FIGS. 1 through 6 thereof, a new cutting device embodying the principles and concepts of an embodiment of the disclosure and generally designated by the reference numeral 10 will be described.

As best illustrated in FIGS. 1 through 6, the cutting apparatus 10 generally comprises a housing 12 that has a first end wall 14, a second end wall 16 and a perimeter wall 18 that is attached to and extends between the first 14 and second 16 end walls. The perimeter wall 18 includes a first side wall 20, a second side wall 22, a front wall 24 and a rear wall 26. The first end wall 14 has a blade aperture 28 extending therethrough. The first end wall 14 has a greater width than the second end wall 16 measured from the first side wall 20 to the second side wall 22 so that the housing 12 includes a narrow portion 30 adjacent to the second end wall 16 and a wide portion 32 adjacent to the first end wall 14. In particular, the second side wall 22 bows outwardly in an arcuate fashion from a central area between said first 14 and second 16 end walls until it intersects the first end wall 14. This produces a ridge 34 at a juncture of the wide 34 and narrow 32 portions against which a hand may be positioned for stability.

A fixed blade 36 is mounted in the housing 12 and extends through the blade aperture 28. The fixed blade 36 includes a sharp edge 38 facing the second side wall 22. The sharp edge 38 is angled from the second side wall 22 toward the first side wall 20 as the fixed blade extends outwardly of the housing 12. The fixed blade 36 is mounted on a raised member 39 on the rear wail 26 to prevent movement of the fixed blade 36.

A pivoting blade 40 is pivotally mounted in the housing 12 and extends through the blade aperture 28. The pivoting blade 40 lies in a plane that is parallel to a plane of the fixed blade 36 and is mounted to the housing 12 by a pivot pin 42 which extends through each of the fixed 36 and pivoting 40 blades. The pivoting blade 40 includes a sharp edge 44 facing the first side wall 20 and the fixed blade 36. The pivoting blade 40 is movable from an open position forming an open space between the fixed 36 and pivoting 40 blades adjacent to the first end wall 14 to a closed position having no open space between the fixed 36 and pivoting 40 blades adjacent to the second end first end wall 14.

An actuator 46 is mechanically coupled to the pivoting blade 40. The actuator 46 pulls the pivoting blade 40 toward the fixed blade 36 when the actuator 46 is actuated. The actuator 46 includes a pulley 48 that is rotatably mounted in the housing 12 and is positioned between the first side wall 20 and the fixed blade 36. The pulley 48 has an axis of rotation extending through the front 24 and rear 26 walls. A lever 50 is slidably mounted to the housing 12 and extends outward of the housing 12 through the first side wall 20. The lever 50 is positioned between the first 14 and second 16 end walls and more particularly may be positioned at the juncture of the narrow 30 and wide 32 portions of the housing 12. An outer portion 57 of the lever 50 extends outwardly of the housing 12 and has a distal end 52 with respect to the housing 12. The outer portion 57 has an upper side 54 directed toward the first end 14 of the housing 12. The upper side 54 is concavely arcuate from the housing 12 to the distal end 52. More particularly, the outer portion 57 curves downward as it extends outwardly of the housing 12 and then upwardly toward the distal end 52. The lever may be slidably positioned in a track in the rear wall.

The actuator 46 further includes a cable 56 that is positioned within the housing 12 and is coupled to the pivoting blade 40 and the lever 50. The cable 56 extends over the pulley 48 and pulls the pivoting blade 40 toward the fixed blade 36 when the lever 50 is moved toward the second end 16 of the housing 12. The cable 56 may be positioned within a notch 58 in the fixed blade 36 to stabilize the cable 56 and ensure that the pivoting blade 40 pivots correctly toward the fixed blade 36. The cable 56 comprises a resiliently bendable material such as woven metallic wires. A biasing member biases the lever 50 toward the first end 14 of the housing 12. The biasing member includes a sleeve 60 mounted in the housing 12 between the pulley 48 and the lever 50. The cable 56 extends into an upper end 62 of the sleeve 60 and through a bottom end 64 of the sleeve 60. A spring 66 is positioned in the sleeve 60 and a stop 68 is mounted on the cable 56. The stop 68 is positioned in the sleeve 60 adjacent to the upper end 62 and abuts the spring 66. The spring 66 biases the stop 68 away from the bottom end 64 of the sleeve 60 to urge the lever 50 toward the first end 14 of the housing 12. The resilient nature of the cable 56 urges the pivoting blade 40 away from the fixed blade 36.

In use, the apparatus 10 is used in a conventional manner for cutting items such paper, small branches, plant material and the like. The positioning of the lever 50 allows a person to extend their thumb over the lever 50 and move the lever 50 downward toward the second end wall 16 in a straight, rather than pivoting, motion. This motion and positioning of the thumb ensures that the person is using the strongest portion of their thumbs and controlling hand muscles to actuate the lever 50 to reduce fatigue and increase efficiency.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cutting apparatus comprising:

a housing having a first end wall, a second end wall and a perimeter wall being attached to and extending between said first and second end walls, said perimeter wall including a first side wall, a second side wall, a front wall and a rear wall, said first end wall having a blade aperture extending therethrough;

a fixed blade being mounted in said housing and extending through said blade aperture, said fixed blade including a sharp edge facing said second side wall;

a pivoting blade being pivotally mounted in said housing and extending through said blade aperture, said pivoting blade lying in a plane being parallel to a plane of said fixed blade, said pivoting blade including a sharp edge facing said first side wall and said fixed blade, said pivoting blade being movable from an open position forming an open space between said fixed and pivoting blades adjacent to said first end wall to a closed position having no open space between said fixed and pivoting blades adjacent to said first end wall; and an actuator being mechanically coupled to said pivoting blade, said actuator pulling said pivoting blade toward said fixed blade when said actuator is actuated; wherein said actuator comprises;

a pulley being rotatably mounted in said housing and having an axis of rotation that extends through said front and rear walls, said axis of rotation being fixed relative to said fixed blade, said pulley being positioned between said first side wall and said fixed blade wherein the minimum distance from said axis of rotation to the first end wall is less than the minimum distance from a pivot axis of said pivoting blade to the first end wall;

a lever being slidably mounted to said housing and extending outward of said housing through said first side wall, said lever being positioned between said first and second end walls, said lever including an outer portion positioned outside of said housing, said outer portion having a distal end with respect to said housing; and a cable being positioned within said housing and being coupled to said pivoting blade and said lever, said cable extending over said pulley and pulling said pivoting blade toward said fixed blade when said lever is moved toward said second end wall of said housing.

2. The apparatus according to claim 1, wherein said first end wall has a greater width than said second end wall measured from said first side wall to said second side wall so that said housing includes a narrow portion adjacent to said second end wall and a wide portion adjacent to said first end wall, said actuator extending outwardly of said housing adjacent to a juncture of said narrow and wide portions.

3. The apparatus according to claim 1, wherein said sharp edge of said fixed blade is angled from said second side wall toward said first side wall as said fixed blade extends outwardly of said housing.

4. The apparatus according to claim 1, wherein said cable comprises a resiliently bendable material.

5. The apparatus according to claim 4, wherein said actuator further includes a biasing member biasing said lever toward said first end wall of said housing.

6. The apparatus according to claim 5, wherein said biasing member includes a spring and a sleeve, said sleeve mounted in said housing between said pulley and said lever, said cable extending into an upper end of said sleeve and through a bottom end of said sleeve, said spring being positioned in said sleeve, a stop being mounted on said cable, said stop being positioned in said sleeve adjacent to said upper end and abutting said spring, said spring biasing said stop away from said bottom end of said sleeve to urge said lever toward said first end wall of said housing.

7. The apparatus according to claim 1, wherein said outer portion having an upper side directed toward said first end wall of said housing, said upper side being concavely arcuate from said housing to said distal end.

8. A cutting apparatus comprising:

a housing having a first end wall, a second end wall and a perimeter wall being attached to and extending between said first and second end walls, said perimeter wall including a first side wall, a second side wall, a front wall and a rear wall, said first end wall having a blade aperture extending therethrough, said first end wall having a greater width than said second end wall measured from said first side wall to said second side wall so that said housing includes a narrow portion adjacent to said second end wall and a wide portion adjacent to said first end wall;

a fixed blade being mounted in said housing and extending through said blade aperture, said fixed blade including a sharp edge facing said second side wall, said sharp edge being angled toward from said second side wall toward said first side wall as said fixed blade extends outwardly of said housing;

a pivoting blade being pivotally mounted in said housing and extending through said blade aperture, said pivoting blade lying in a plane being parallel to a plane of said fixed blade, said pivoting blade including a sharp edge facing said first side wall and said fixed blade, said pivoting blade being movable from an open position forming an open space between said fixed and pivoting blades adjacent to said first end wall to a closed position having no open space between said fixed and pivoting blades adjacent to said first end wall; and an actuator being mechanically coupled to said pivoting blade, said actuator pulling said pivoting blade toward said fixed blade when said actuator is actuated, said actuator including:

a pulley being rotatably mounted in said housing and having an axis of rotation that extends through said front and rear walls, said axis of rotation being fixed relative to said fixed blade, said pulley being positioned between said first side wall and said fixed blade wherein the minimum distance from said axis of rotation to the first end wall is less than the minimum distance from a pivot axis of said pivoting blade to the first end wall;

a lever being slidably mounted to said housing and extending outward of said housing through said first side wall, said lever being positioned between said first and second end walls, said lever being positioned at a juncture of said narrow and wide portions of said housing, an outer portion of said lever extending outwardly of said housing, said outer portion having a distal end with respect to said housing, said outer portion having an upper side directed toward said first end wall of said housing, said upper side being concavely arcuate from said housing to said distal end;

a cable being positioned within said housing and being coupled to said pivoting blade and said lever, said cable extending over said pulley and pulling said pivoting blade toward said fixed blade when said lever is moved toward said second end wall of said housing, said cable comprising a resiliently bendable material; and a biasing member biasing said lever toward said first end wall of said housing, said biasing member including a spring and a sleeve, said sleeve mounted in said housing between said pulley and said lever, said cable extending into an upper end of said sleeve and through a bottom end of said sleeve, said spring being positioned in said sleeve, a stop being mounted on said cable, said stop being positioned in said sleeve adjacent to said upper end and abutting said spring, said spring biasing said stop away from said bottom end of said sleeve to urge said lever toward said first end wall of said housing.

* * * * *